US006893014B2

(12) United States Patent
Baker et al.

(10) Patent No.: US 6,893,014 B2
(45) Date of Patent: May 17, 2005

(54) RETROFIT PRINTER GUIDE CLIP

(75) Inventors: Timothy B. Baker, Miamisburg, OH (US); Thomas J. Obringer, Vandalia, OH (US); Timothy W. Rawlings, Waynesville, OH (US); James M. Seybold, Centerville, OH (US); John E. Sloss, Fremont, CA (US)

(73) Assignee: NCR Corporation, Dayton, OH (US)

( * ) Notice: Subject to any disclaimer, the term of this patent is extended or adjusted under 35 U.S.C. 154(b) by 145 days.

(21) Appl. No.: 10/304,402

(22) Filed: Nov. 26, 2002

(65) Prior Publication Data

US 2004/0100015 A1 May 27, 2004

(51) Int. Cl.[7] ..... B65H 3/56
(52) U.S. Cl. ..... 271/169; 271/170
(58) Field of Search ..... 271/169, 170, 271/109, 113, 264, 10.09, 10.11

(56) References Cited

U.S. PATENT DOCUMENTS 4,623,138 A * 11/1986 Sakamaki et al. ..... 271/170
5,992,843 A * 11/1999 Lee ..... 271/170
6,550,760 B1 * 4/2003 Fisher, Sr. ..... 271/19

FOREIGN PATENT DOCUMENTS

JP 62088740 A * 4/1987 ..... B65H/3/56
JP 62205944 A * 9/1987 ..... B65H/3/56

OTHER PUBLICATIONS

Lexmark T520 Printer, Lexmark International, Inc., Lexington, KY, 12 photos, on sale in USA for more than one year before Nov. 26, 2002.

* cited by examiner

*Primary Examiner*—Donald R. Walsh
*Assistant Examiner*—Kaitlin Joerger
(74) *Attorney, Agent, or Firm*—Francis L. Conte, Esq.

(57) ABSTRACT

A printer guide clip is configured for retrofit in a paper tray of pre-existing commercially available printer for blocking corner curling of forms transported therethrough. The clip includes first and second side tabs integrally joined together by an arcuate cap extending between the top ends thereof. The first tab is configured for retention inside a pre-existing slot in the paper tray. An inclined ramp extends outwardly from the second tab inside the tray in the vicinity of the form corner for blocking curling thereof during use. The clip is readily attachable to the tray for use with laminated forms, and is easily removable therefrom when no longer needed.

17 Claims, 3 Drawing Sheets

RETROFIT PRINTER GUIDE CLIP

BACKGROUND OF THE INVENTION

The present invention relates generally to printers, and, more specifically, to paper feeding therein.

Laser printers are manufactured in different models by different manufacturers and offer different performance. Printing paper may be stored in the printer in various forms of trays.

One form of tray is a drawer which slides horizontally into and out of a corresponding compartment in the printer. The drawer tray has a central well or receptacle in which a stack of printing paper may be held.

The drawer is closed during operation, and pickup rollers are moved into position atop the stack of paper for initially driving individual sheets into the feedpath of the printer. As the individual sheets of paper leave the tray, one or more drive rollers begin the sheet transport through the printer for printing any desired information thereon and ejecting the printed sheet in an output tray for recovery.

A printer may include one or more stacked drawer trays with or without duplexing capability for feeding the paper sheets through the printer for printing one or both sides thereof as desired. The trays may have different configurations and capacity for holding the paper sheets, and have pickup and drive rollers specifically configured therefor.

Besides plain paper sheets for use in the printers, laminated form sheets may also be transported therethrough for printing. A laminated sheet typically includes a base sheet laminated to a liner by pressure sensitive adhesive a silicone release agent therebetween in a typical example. The liner may extend for the full configuration of the base sheet, or may cover only a small portion thereof depending upon the nature of the particular sheet.

For example, a pharmacy script form includes a single ply form sheet integrated with an extension thereof in a two-ply laminate with a release liner. The base sheet above the liner is die cut to define one or more removable labels initially bonded by the pressure sensitive adhesive to the liner.

Both the form sheet and the individual labels can be printed in one pass through the printer for improving the typical pharmaceutical transaction.

However, the two-ply form is more complex than a single ply bond paper sheet and is subject to undesirable curling during transport in the printer which may lead to problems therein. For example, one problem has recently been discovered in the development of a two-ply pharmacy script form in a specific commercially available laser printer, but not in other commercially available laser printers. In this printer, one corner of the two-ply form sheet experiences excessive curling during initial feeding of the sheet from the paper tray, with the corner being bent over backwards in dog-ear fashion upon engaging the first drive roller in the feedpath.

Accordingly, it is desired to provide a remedy for undesirable laminate curling in a pre-existing commercially available printer without requiring changes thereof by the original equipment manufacturer.

BRIEF SUMMARY OF THE INVENTION

A printer guide clip is configured for retrofit in a paper tray of pre-existing commercially available printer for blocking corner curling of forms transported therethrough. The clip includes first and second side tabs integrally joined together by an arcuate cap extending between the top ends thereof. The first tab is configured for retention inside a pre-existing slot in the paper tray. An inclined ramp extends outwardly from the second tab inside the tray in the vicinity of the form corner for blocking curling thereof during use. The clip is readily attachable to the tray for use with laminated forms, and is easily removable therefrom when no longer needed.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
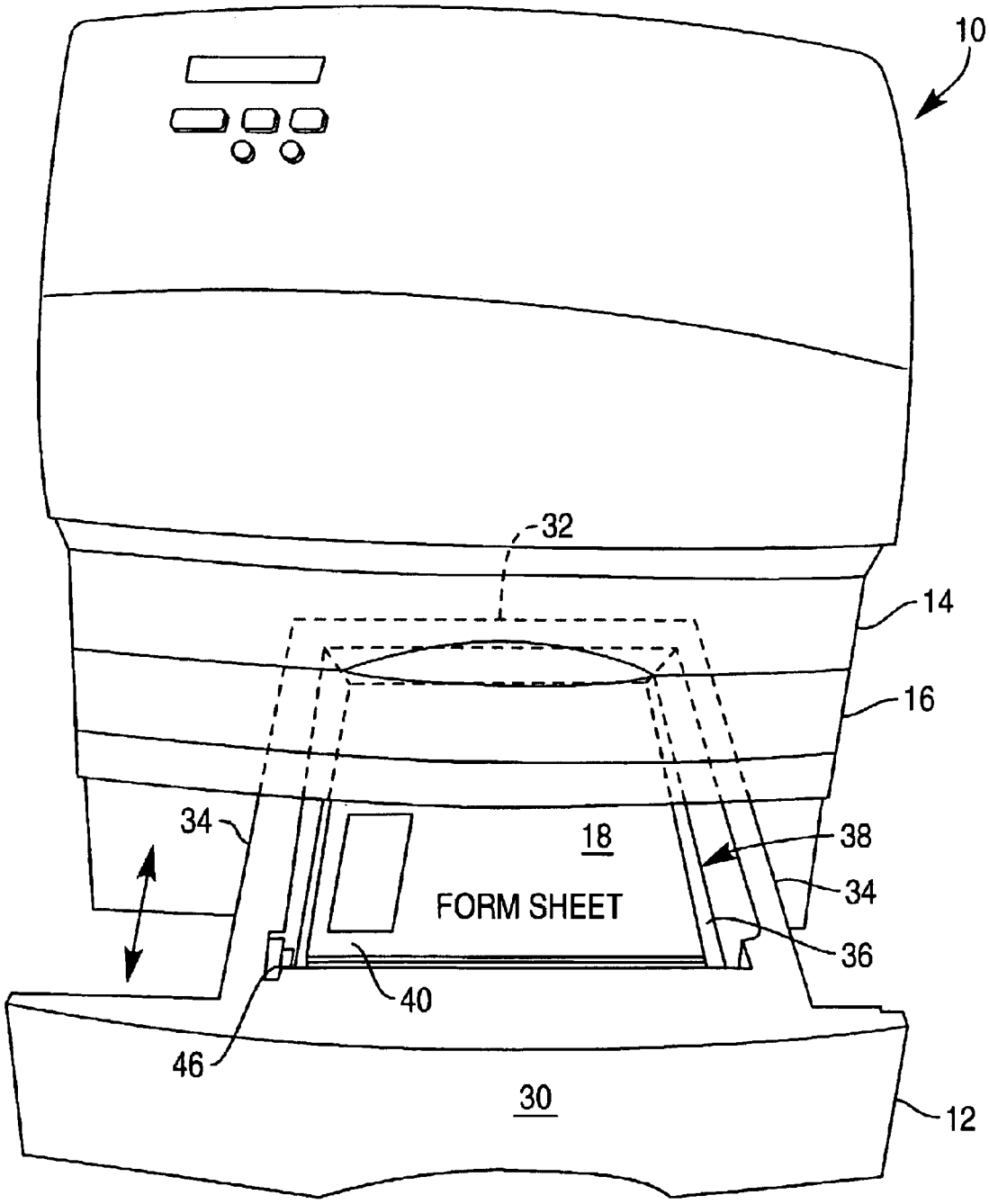
FIG. 1 is a front elevational view of exemplary laser printer with a partially open lower paper tray including a guide clip in accordance with one embodiment of the present invention.

Illustrated in FIG. 1 is an exemplary laser printer 10 including a lower feed drawer or tray 12, shown partly open, an upper drawer or tray 14, shown closed, and a duplexer module 16 mounted vertically therebetween. The basic printer is conventional and feeds sheets 18 of any suitable composition and configuration from either tray for transport through the printer for printing any desired printing or one or both sides thereof.

Figure 2:
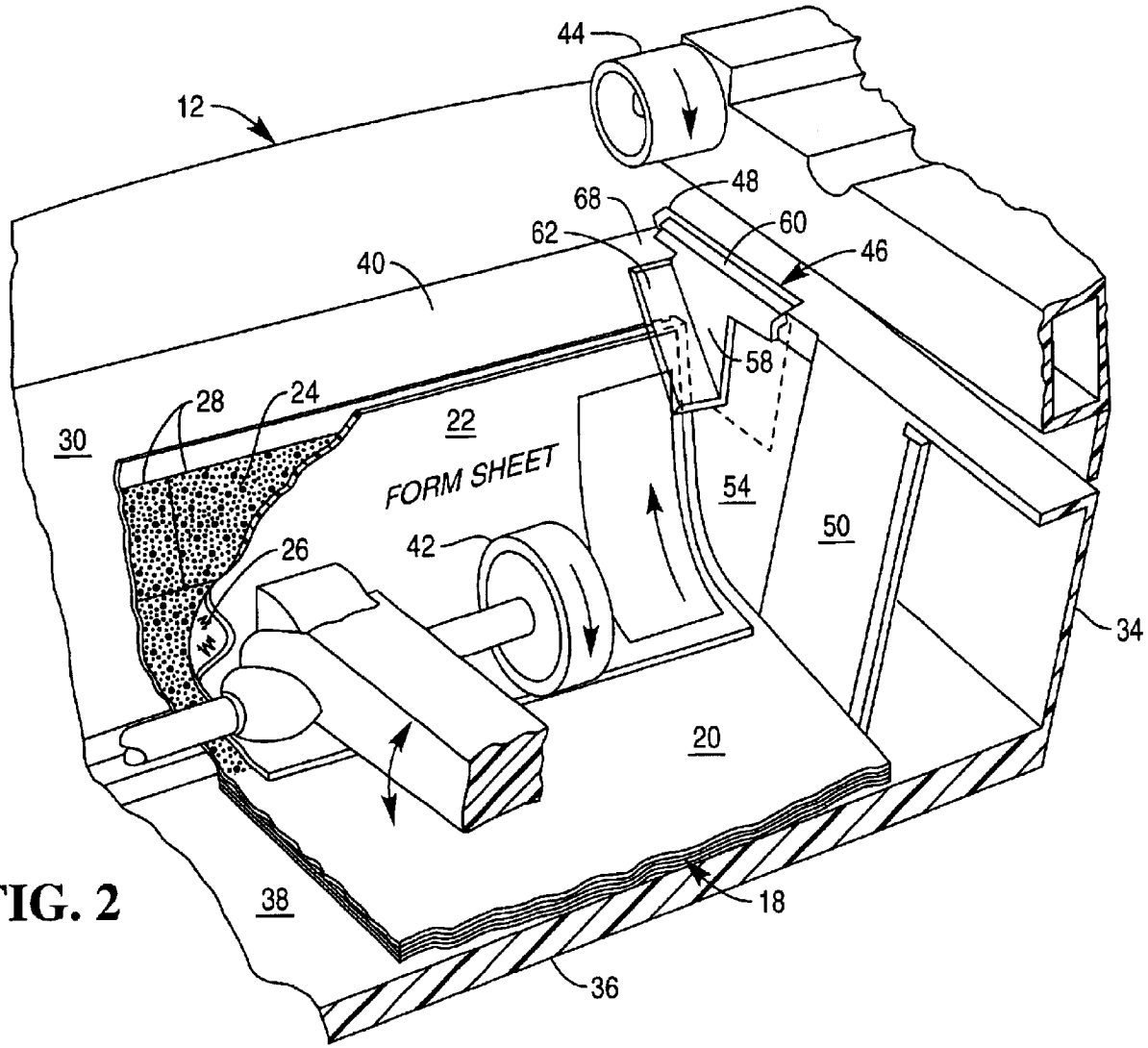
FIG. 2 is an enlarged isometric view of a front corner of the paper tray shown in FIG. 1 illustrating the installed guide clip in greater detail.

FIG. 2 illustrates a portion of a stack of the sheets 18 stored in the lower tray 12, with the sheets being in the exemplary form of two-ply laminated form sheets. Each form includes a base sheet 20 laminated to a release liner 22 by pressure sensitive adhesive 24 and a release agent 26 such as silicone. The base sheet has a standard rectangular configuration and size, such as 8½ by 14 inches, and the liner is slightly less than 8½ inches wide and about 5 inches long, or shorter, for covering only the leading edge portion of the form.

The base sheet is die cut to form variously sized removable labels 28 which may be peeled away from the underlying release liner. The base sheet is typically bond paper, and the release liner is typically supercalendared kraft (SCK) paper, although bond paper may also be used, coated with silicone on one side for permitting easy removal of the pressure sensitive adhesive labels when desired.

The printer 10 illustrated in FIG. 1 is conventional, such as a Lexmark T520 laser printer with or without the duplexer, and is commercially available from Lexmark International Inc., Lexington, Ky. The lower tray 12 is typically sized and configured for holding a ream of 500 sheets of paper. The upper tray 14 may be sized and configured for holding a full ream or half ream of paper depending on the particular model in the T or S series of Lexmark printers.

The lower tray 12 illustrated in FIG. 1 is primarily made of plastic with selective use of metal components therein, and includes front and back walls 30,32, two opposite sidewalls 34, and a closed bottom or floor 36 all joined together in a rectangular configuration defining a well 38 for holding a stack of the form sheets 18.

The laminated form sheets 18 illustrated in FIG. 2 are being developed for use as pharmacy scripts for recording commercial pharmaceutical transactions. The pharmaceutical forms 18 may be fed in a single pass through the printer for printing one or both sides of the form, including the laminated labels in the two-ply section as well as the single ply portion of the form. The pharmacist may then remove one or more of the individual labels and apply them to the pharmaceutical container, with the remaining single ply portion of the form sheet containing written instructions for the customer and a record of the pharmaceutical transaction.

Since the forms are intended for use by various pharmacies having various printers, it is desirable that the same two-ply pharmaceutical form be readily usable in any commercially available laser printer. However, it has been discovered during the development of the forms and testing in various laser printers manufactured by different companies, that corner curling of the forms being fed from the paper tray may occur in the above described series of Lexmark printers, but no curling occurs in other types of laser printers tested during development. Furthermore, it has also been discovered that corner curling of the forms appears to occur solely in the lower tray 12 illustrated in FIG. 1 but not in the upper tray 14, which may be due to the different sizes or configurations thereof and feedpaths therefrom.

Corner curling of the form sheets being fed from the feed trays is undesirable since the corners can be bent over backwards in a typical dog-ear fashion during transport through the printer, which damages the form and may cause jamming inside the printer.

FIG. 2 illustrates in isolation the forward left corner 40 of the lower feed tray 12 defined by the intersection of the front wall 30 and left sidewall 34 in the exemplary Lexmark printer. The lower tray is shown installed in the printer, and the surrounding portions of the printer are removed for clarity of presentation. The printer includes a pair of pickup rollers 42, one of which is shown, which are suitably supported inside the printer from a cantilevered boom which hangs in position atop the stack of forms when the tray is closed. The pickup rollers are driven to frictionally engage the top sheet of the stack and drive that sheet forwardly and upwardly along the inclined inner surface of the front wall 30 of the tray.

As the leading edge of the top sheet leaves the lower tray it is met by a conventional drive roller 44 which frictionally engages the side of the form to continue transporting the form through the printer, which further includes a series of drive rollers for completing the transport path to the output tray of the printer.

The drive wheel 44 illustrated in FIG. 2 is directly in line with one of the forward corners of the form being fed into the printer, and any curling of that forward corner can lead to the undesirable dog-ear bend as the drive roller 44 frictionally engages the curled corner.

This problem appears to be caused by the two-ply form of the sheets 18 which are fed through the printer with the two-ply portion of the sheet leading the single ply portion of the sheet. The problem also appears to be caused by the pickup rollers 42 driving the sheet up the inclined front wall 30 over an extended distance before reaching the drive roller 44 suitably mounted in the printer above the lower tray.

In accordance with the present invention, a method is provided for blocking curling of the forward corner of the form being withdrawn from the lower feed tray 12 in the Lexmark printer. A particular advantage of the method is that no changes by the original manufacturer of the printer are required in the printer, nor are any changes required in the two-ply form sheet itself. Instead, a discrete guide clip 46 initially illustrated in FIGS. 1 and 2 is installed or retrofitted into the lower tray 12 in a pre-existing slot 48 conveniently disposed in the forward corner 40 of the tray.

Figure 3:
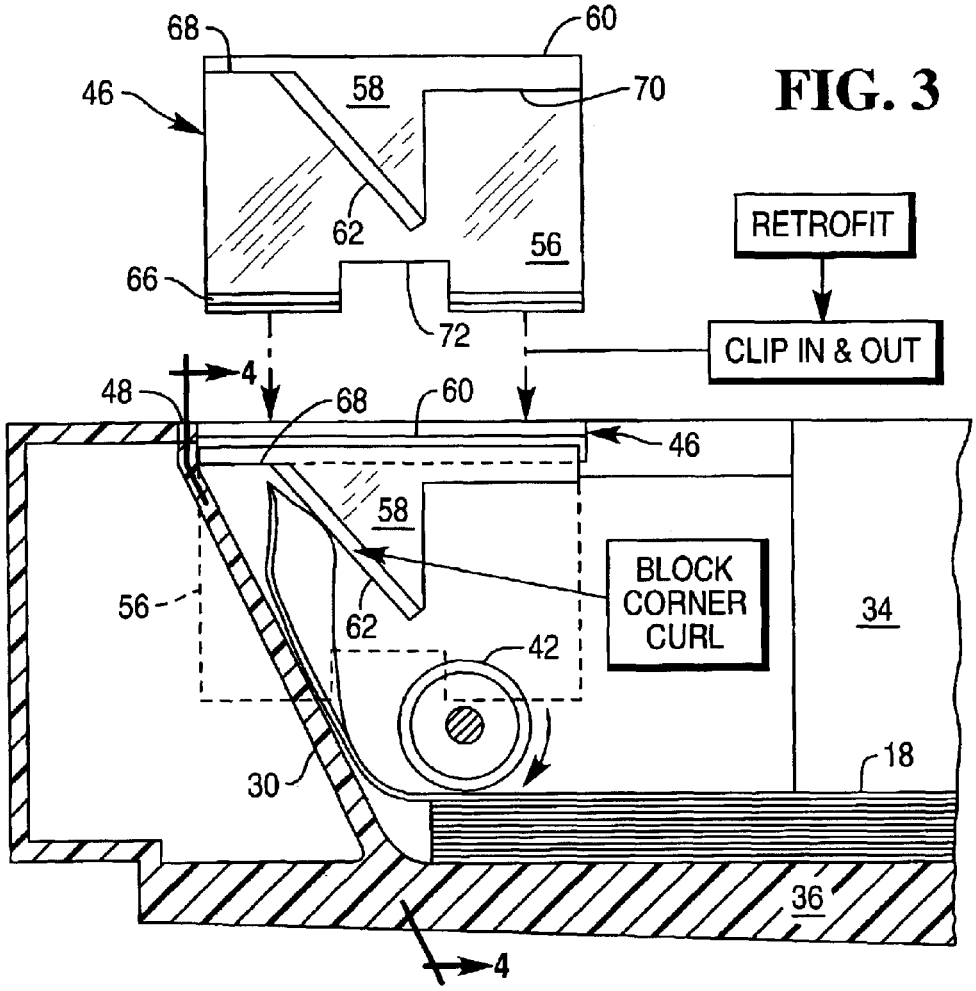
FIG. 3 is a partly sectional, side elevational view of the guide clip illustrated in FIG. 2 in installed and removed positions in the paper tray.
Figure 4:
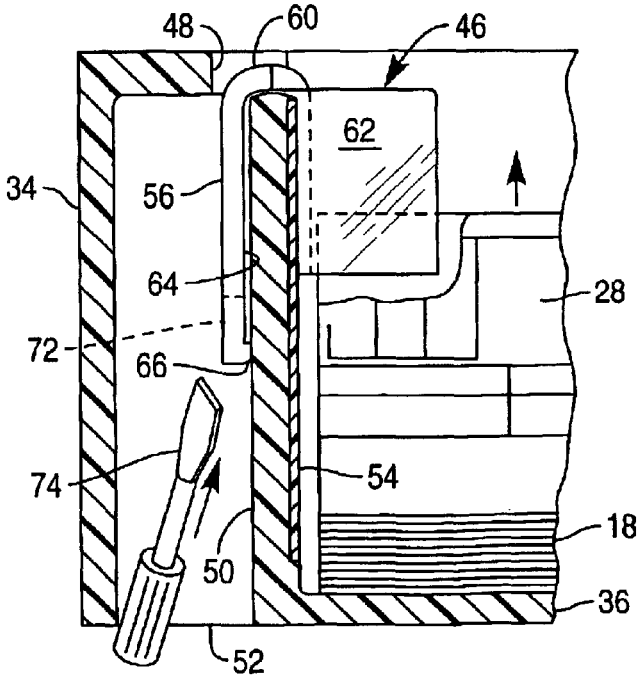
FIG. 4 is a partly sectional, front elevational view of the guide clip installed in the tray illustrated in FIG. 3 and taken along line 4—4.

As shown in FIGS. 2 and 3 the slot 48 is conveniently located in the upper surface of the left sidewall 34 and extends longitudinally therealong for about 1.5 inches from the top of the inclined front wall 30 along which the forms are fed from the lower tray. As shown in FIG. 4, the left sidewall 34 is a hollow, box construction for reducing its weight and includes an internal gusset or rib 50 which extends downwardly from the slot 48 to the tray bottom 36 terminating at an exposed opening 52 therethrough. The sidewall rib 50 includes a thin metal plate 54 affixed to the inner surface thereof defining in part the tray well in which the stack of forms is held.

Since the slot 48 is provided by the original manufacturer of the printer and is conveniently located in the forward corner 40 of the tray in which the curling problem has developed, it is used in accordance with the present invention for mounting the guide clip 46 which is correspondingly configured to block or limit the amount of corner curling to prevent the dog-ear bending problem.

More specifically, the guide clip 46 is illustrated in FIG. 3 in two positions just prior to installation in a tray as well as fully installed in the tray, and simply clips in or out of the tray by vertical movement. The clip includes first and second side tabs 56,58 integrally joined together at top ends thereof by an arcuate cap 60. Extending obliquely or perpendicularly outwardly from the bottom end of the second tab 58 is a flat chute or ramp 62 sized and configured to limit or block corner curling of the sheet 18 as illustrated in FIG. 3. The entire clip 46 is preferably a unitary or one-piece assembly of its components, and may be formed of molded plastic of any suitable composition, and may be transparent as illustrated, or opaque as desired.

As shown in FIG. 3, the first tab 56 is preferably rectangular and is sized between it forward and aft ends to fit within the length of the slot 48. It is also sized in height between the top and bottom ends thereof to enter the slot vertically and extend downwardly inside the slot.

The second tab 58 is preferably triangular having top and bottom ends disposed substantially parallel with the first tab, and is integrally joined thereto by the cap 60 extending laterally therebetween. The second tab 58 extends downwardly outside the slot 48 and inside the well of the tray.

As shown in FIGS. 2 and 4 the ramp 62 is preferably rectangular and is inclined downwardly inside the tray well between the forward and aft ends of the second tab.

As indicated above, the first and second tabs, cap, and ramp are preferably formed as a unitary molded plastic assembly, and therefore preferably have a uniform or common thickness, of about 62 mils for example. As shown in FIG. 4, the two tabs are placed laterally apart to define an inverted U-channel 64 therebetween which is sized substantially equal to the thickness of the tray rib 50 so that the tabs self-clamp the clip on opposite sides of that rib for retention thereto.

The bottom end of the first tab 56 may include a raised lip 66 extending between the forward and aft ends thereof to provide a line of contact between the first tab and the tray rib 50 for clamping thereat, and therefore prevents any obstruction between the remainder of the first tab and the tray rib due to manufacturing tolerances therebetween. The plastic material of the clip is preferably slightly elastic so that the two side tabs of the clip may be slightly sprung apart during the retrofit installation thereof for developing suitable clamping forces for retaining the clip in the tray thereafter.

In use, the clip 46 illustrated in FIG. 3 is simply manually inserted downwardly into the lower tray, with the first tab 56 being inserted downwardly into the slot 48 for being trapped therein. The second tab 58 and attached ramp 62 are disposed inside the tray well, with the two tabs 56,58 being self-clamping on opposite sides of the internal rib 50 as illustrated in FIG. 4.

As shown in FIG. 3, the ramp 62 is configured and positioned inside the well for limiting or blocking curling of the individual forms 18 as they are driven out of the tray and into the transport path of the printer.

More specifically, the ramp 62 is inclined downwardly between its forward and aft ends to generally match the inclination angle of the tray front wall 30 along which the form sheets are driven upwardly and out of the tray. For example, the inclination angle of the ramp 62 may be about 50 degrees from the horizontal.

As also illustrated in FIG. 3, the ramp 62 and supporting second tab 58 are preferably spaced aft from the forward end of the first tab to define a laterally extending forward recess or notch 68 for receiving a forward corner of each form being withdrawn from the lower tray. As shown in FIGS. 2 and 3, the forward notch 68 provides a relatively small clearance between the front wall 30 and the ramp 62 for receiving the corner of the form and directing it for proper engagement with the drive wheel 44 to prevent dog-ear bending thereof.

As shown in FIG. 3, the ramp 62 and its supporting tab 58 are preferably spaced forwardly from the aft end of the first tab 56 to define a vertical aft notch 70 which positions the ramp closer to the forward end of the first tab and closer to the front wall of the tray. In this way, the ramp 62 defines a narrow channel with the front wall 30 to guide the corner of the form out of the tray and into engagement with the drive roller 44 illustrated in FIG. 2 to prevent the dog-ear bending problem.

As initially shown in FIG. 3, the first tab 56 preferably includes a vertical central notch 72 at the bottom end thereof which faces downwardly. As shown in FIG. 4, the central notch 72 faces the bottom opening 52 in the tray bottom 36 and provides access to the first tab 56 otherwise hidden in the sidewall of the tray. The central notch is provided for permitting easy removal of the clip from the tray by a tool 74 in the preferred form of a screwdriver having a flat end sized to engage the central notch of the first tab. The first tab, and therefore the entire clip, may then be pushed outwardly from the slot 48 for removing the clip when desired.

As indicated above, the exemplary printer includes the pickup roller 42 illustrated in FIG. 2 which hangs inside the lower tray adjacent to one of the form corners for driving the form to engage the drive roller 44 located thereabove. Without the use of the guide clip 46 for the two-ply configuration of the sheets 18, forward corner curling can occur leading to undesirable dog-ear bending thereof.

By simply retrofitting the guide clip 46 in the pre-existing slot 48 in the tray sidewall 34, the ramp 62 is preferentially located to guide the form sheets as they are fed into the printer. As shown in FIG. 3, the ramp 62 is suitably inclined inside the tray forward corner to limit curling of the form corner during sheet feeding or transport. As the driven sheet begins to curl during transport, the curling corner engages the ramp 62 which limits that curling and re-directs the form corner under the drive roller 44 to prevent dog-ear bending.

The retrofit guide clip 46 is therefore specifically sized and configured for limiting curling of one of the form corners during transport, and otherwise does not block proper operation of the lower tray itself. The lower tray continues to operate as intended by the original manufacturer without obstruction in operation by the retrofit guide clip. And, the guide clip may be simply removed for using the original lower tray as intended with other sheets of paper not subject to curling as found in the specialty two-ply pharmaceutical form sheet.

The guide clip is conveniently small and inexpensive, and may be simply installed without any tools or difficult instructions in the field by the owner or operator of the specific printer. The clip may be readily removed by pulling the ramp upwardly, or the tool 74 may be used to push the first tab upwardly depending on the amount of clamping force.

In the preferred embodiment illustrated in the several figures the ramp 62 is substantially flat and small in configuration, but may otherwise be modified as desired for optimizing its use without otherwise comprising the intended performance of the lower tray.

In view of inherent differences in construction and operation of the upper tray of the printer as opposed to the lower tray, the guide clip is not required therein should the two-ply specialty forms be used in that upper tray.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A retrofit guide clip for a paper tray in a printer having a slot at a forward end thereof, said clip comprising:

a first side tab having top and bottom ends sized to enter said slot vertically;

an arcuate cap extending laterally from said tab top end;

a second side tab having top and bottom ends disposed substantially parallel with said first tab, and integrally joined thereto by said cap; and a ramp extending obliquely from said second tab and inclined downwardly between forward and aft ends of said second tab.

2. A clip according to claim 1 wherein:

said first tab is rectangular;

said second tab is triangular; and said ramp is rectangular.

3. A clip according to claim 2 wherein said first and second tabs, cap, and ramp form a unitary assembly having a common thickness.

4. A clip according to claim 3 wherein said second tab and ramp are spaced aft from a forward end of said first tab to define a forward notch for receiving a corner of a form being withdrawn from said tray.

5. A clip according to claim 4 wherein said second tab and ramp are spaced forward from an aft end of said first tab to define an aft notch positioning said ramp closer to said forward end of said first tab.

6. A clip according to claim 5 wherein said first tab includes a central notch at said bottom end thereof for removing said clip from said tray by prying with a tool.

7. A clip according to claim 5 wherein said first and second tabs are spaced apart to define a channel therebetween sized to clamp said clip on opposite sides of a rib of said tray at said slot.

8. A paper tray for a printer comprising:

front and back walls, two sidewalls, and a bottom defining a well for holding a stack of forms;

one of said sidewalls and said front wall being joined at a forward corner of said well, and said one sidewall including a slot therein; and a guide clip retrofit into said slot, and including first and second side tabs joined together at top ends by an arcuate cap, with said second tab having an integral ramp extending perpendicularly outwardly therefrom inside said well, and said first tab being trapped inside said slot.

9. A tray according to claim 8 wherein:

said first tab is rectangular and extends downwardly inside said slot;

said second tab is triangular and extends downwardly outside said slot and inside said well; and said ramp is rectangular and is inclined downwardly inside said well between forward and aft ends of said second tab.

10. A tray according to claim 9 wherein said first and second tabs, cap, and ramp form a unitary assembly having a common thickness, and said tabs are clamped about a rib of said tray extending downwardly from said slot.

11. A tray according to claim 10 wherein said second tab and ramp are spaced aft from a forward end of said first tab to define a forward notch for receiving a corner of a form being withdrawn from said tray.

12. A tray according to claim 11 wherein said second tab and ramp are spaced forward from an aft end of said first tab to define an aft notch positioning said ramp closer to said forward end of said first tab.

13. A tray according to claim 12 wherein said first tab includes a central notch at said bottom end thereof facing downwardly towards an opening in said tray bottom for removing said clip from said tray by prying with a tool.

14. A method of blocking curl of a corner in a form being withdrawn from a tray in a printer comprising:

retrofitting in said tray a guide clip in a pre-existing slot disposed in a forward corner thereof;

said clip including a first tab inserted downwardly into said slot;

said clip further including a second tab joined to said first tab by an integral cap therebetween, with said second tab being inserted downwardly inside said forward corner; and said clip further including an integral ramp extending perpendicularly outwardly from said second tab for blocking curl of said form corner as said form is withdrawn from said tray.

15. A method according to claim 14 wherein:

said form comprises a two-ply laminate having a base sheet laminated to a liner by a adhesive and release;

said tray is sized and configured to curl said form when said form is transported out of said tray inside said printer; and said ramp is inclined inside said tray forward corner to limit curling of said form corner during said transport.

16. A method according to claim 15 wherein:

said printer further includes a drive roller disposed near said tray forward corner; and said ramp is positioned in said tray to redirect said form corner under said roller to prevent dog-ear bending thereof.

17. A method according to claim 16 wherein said printer further includes a pickup roller hanging inside said tray adjacent said form corner for driving said form past said ramp to engage said drive roller.

* * * * *